United States Patent [19]

Nasvytis et al.

[11] 3,941,505

[45] Mar. 2, 1976

[54] METHOD AND APPARATUS FOR PUMPING FUEL

[75] Inventors: Pius J. Nasvytis, Willoughby; Milton W. Mueller, Cleveland, both of Ohio

[73] Assignee: TRW Inc., Cleveland, Ohio

[22] Filed: June 25, 1973

[21] Appl. No.: 373,603

[52] U.S. Cl. ..... 417/202; 417/203; 417/205; 417/223; 417/252; 418/17; 418/23

[51] Int. Cl.[2] ..... F04B 23/14; F04B 49/00

[58] Field of Search ..... 417/201, 202, 203, 205, 417/206, 213, 220, 283, 293, 294, 223, 252, 62; 418/17, 23, 253

[56] References Cited

UNITED STATES PATENTS

| | | | |
|---|---|---|---|
| 1,116,998 | 11/1914 | Compton | 417/223 |
| 1,940,024 | 12/1933 | Shaff | 91/59 |
| 2,292,896 | 8/1942 | Morgan | 417/202 |
| 2,443,527 | 6/1948 | Wirth | 417/201 |
| 2,612,844 | 10/1952 | Grise | 417/202 |
| 2,666,393 | 1/1954 | Troeger | 417/202 |
| 2,758,547 | 8/1956 | Wendell | 417/201 |
| 3,136,849 | 5/1967 | Cooper | 417/202 |
| 3,184,024 | 5/1965 | Aschauer | 417/203 |
| 3,532,441 | 10/1970 | Schofield | 417/203 |
| 3,578,880 | 5/1971 | Cygnor | 417/203 |
| 3,584,974 | 6/1971 | Nicastro | 417/202 |
| 3,635,602 | 1/1972 | Grennan et al. | 417/216 |
| 3,784,329 | 1/1974 | Crawley | 417/252 |

FOREIGN PATENTS OR APPLICATIONS

| | | | |
|---|---|---|---|
| 654,854 | 7/1951 | United Kingdom | 417/203 |
| 918,798 | 2/1963 | United Kingdom | 417/202 |
| 804,265 | 11/1958 | United Kingdom | 417/201 |

*Primary Examiner*—William L. Freeh
*Assistant Examiner*—G. P. LaPointe
*Attorney, Agent, or Firm*—Hill, Gross, Simpson, Van Santen, Steadman, Chiara & Simpson

[57] ABSTRACT

Method and apparatus for pumping fuel to jet engines and the like utilizing at least two stages, the first of which is a main stage including a centrifugal pump, together with a secondary stage including a positive displacement pump. The two pump stages are driven from a common drive means. In the new system, the positive displacement pump is used as a startup pump and the centrifugal pump is the sole pumping means employed during conditions of higher fuel demand. Speed responsive means are provided in conjunction with the positive displacement pump, which means are responsive to the speed of the centrifugal pump, the speed responsive means being used to terminate pumping action by the positive displacement upon the centrifugal pump reaching a predetermined speed.

11 Claims, 5 Drawing Figures

Fig-1
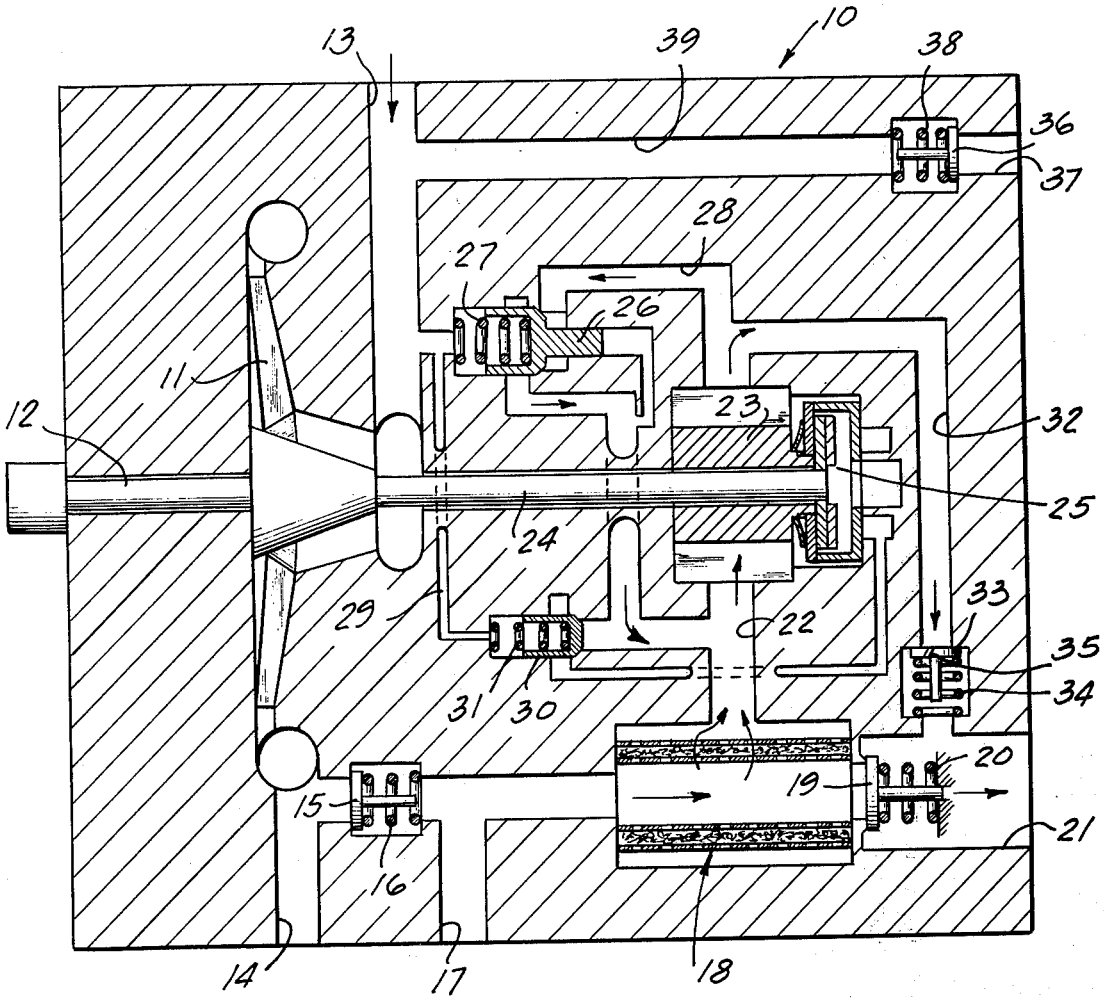
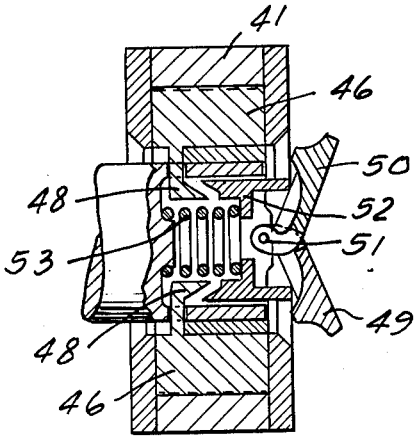
Fig-2

METHOD AND APPARATUS FOR PUMPING FUEL

BACKGROUND OF THE INVENTION

1. Field of the Invention

The present invention is in the field of multi-stage pumping systems particularly designed for use with modern jet aircraft engines. It includes a centrifugal pump which characteristically has a long life and a positive displacement pump to meet cranking suction requirements.

2. Description of the Prior Art

As gas turbine engine technology advances, the requirements for engine accessories such as engine pumps are considerably more demanding. Engine manufacturers now require engine pumps which are light, compact, very efficient, capable of operating with contaminated and low lubricity fuels, long-lasting, reliable, easy to maintain and inexpensive. Experience with conventionally designed engine pumps such as positive displacement, gear or vane, or variable displacement vane pumps has demonstrated that conventional designs are not capable of meeting the ultimate demands of the aircraft engine industry.

SUMMARY OF THE INVENTION

The pumping assembly of the present invention provides a combination of a centrifugal main stage pump operating at a high speed and a positive displacement pump such as a vane or gear pump protected by a filter which satisfies dry lift and cranking flow requirements. In a preferred embodiment of the invention, a system of valves and a simple pressure operated clutch are used to unload and disengage the vane pump after startup, thereby requiring only the centrifugal stage to satisfy engine operating requirements including the handling of contaminants in the fuel.

With the new system, the pump size and weight are minimized because of the high operating speeds and resultant small pump stage sizes. Since the vane pump operates only for short intervals, only minimal filter capacity is required to insure clean fuel to the vane pump and a continuous supply of clean lubricant for the bearing journals. The life of the vane pump will be prolonged because of the low loads encountered and the complete deactivation of the vane pump after the engine is started. Due to such low loads, the vane stage operates satisfactorily with low lubricity fuels. The system of the present invention takes advantage of the fact that a centrifugal pump has a high immunity to contaminants and low lubricity fuels. With the system of the present invention, the main centrifugal stage is automatically self-limiting upon rises in pressure, so that no pressure relief valve is required. Furthermore, the temperature rise at conditions of low through-flow is significantly reduced as compared with the fixed positive displacement pumps.

In a particularly preferred embodiment of the present invention, these advantages are obtained by providing the combination of a commonly driven centrifugal pump and a vane pump, with a filter being located at the inlet of the vane pump. A relief valve is disposed across the vane pump, the relief valve being responsive to the pressure differential between the inlet and the outlet of the vane pump. A pressure actuated clutch is arranged to engage and disengage the vane pump at a predetermined output pressure of the centrifugal pump. A discharge port is provided for discharging pressurized fluid from the pumping assembly and a resistance valve is located between the output of the vane pump and the discharge port. A clutch actuation valve is connected between the relief valve and the pressure actuated clutch to actuate the clutch upon establishment of a predetermined pressure in the relief valve. When operating pressures are achieved in the system, a check valve between the filter and the discharge port is opened permitting substantially the entire output flow of the centrifugal pump to be directed to the engine.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which:

FIG. 1 is a partially schematic representation of an improved pumping assembly embodying the improvements of the present invention;

FIG. 2 is a vertical cross-sectional view through a type of vane pump assembly which can be used for the purpose of the present invention and which employs a centrifugally responsive means for mechanically deactivating the vane pump;

DESCRIPTION OF THE PREFERRED EMBODIMENTS

Figure 3:
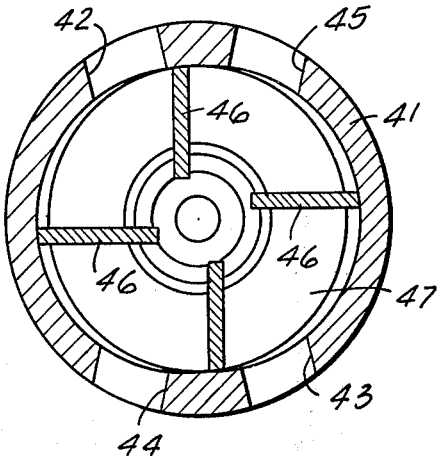
FIG. 3 is a vertical cross-sectional view of the rotor and vane assembly of the pump shown in FIG. 2.

In FIG. 1, reference numeral 10 indicates generally a combined centrifugal pump - vane pump assembly for use in accordance with the present invention. The centrifugal pump portion or main stage includes an impeller 11 driven by an input shaft 12, from a suitable prime mover (not shown) and arranged to drive the impeller 11 at a speed typically on the order of 24,000 rpm. An inlet 13 directs the fuel into the centrifugal stage to be directed to an outlet 14 to a heater (not shown). A heater bypass valve consisting of a valve element 15 biased into closed position by means of a spring 16 is optionally included. Heated fuel returning from the heater is directed through an inlet 17 and flows through a filter generally indicated at numeral 18 of the drawings. A check valve consisting of a valve element 19 biased by a spring 20 controls the ingress of fuel into a discharge port 21 which is in fluid communication with the engine.

Filtered fuel during the cranking operation is directed into an inlet port 22 which feeds a vane pump including pumping vanes 23 mounted on a shaft 24 which rotates at the same speed as the impeller 11 of the centrifugal pump assembly. A pressure actuated clutch assembly 25 is provided to actuate or deactuate the vane pump depending on the output of the centrifugal stage.

Regulation of the pressure of the vane pump is accomplished by means of a relief valve assembly including a valve element 26 biased by means of a spring 27. Fluid under pressure from the vane pump operates against the valve element 26 through a passage 28.

A passage 29 at the output side of the relief valve communicates the latter to a clutch actuation valve element 30 which is biased by means of a spring 31.

A discharge passage 32 communicates the output of the vane pump to a resistance valve element 33 under a biasing pressure provided by a spring 34 and communicating with the discharge port 21. A small vent hole 35 is provided in the resistance valve to allow air to be pumped by the vane stage during dry lift cranking. Completing the assembly is a body valve element 36 located in a return flow port 37, the valve element 36 being normally biased in a closed position by means of a spring 38. Fluid flowing through the valve element upon opening of the valve is directed by means of a passage 39 into the inlet 13 of the centrifugal pump assembly.

In operation, the fuel entering the pump inlet 13 is pressurized by the centrifugal pump impeller 11 and directed through the fuel heater, if used, and into the filter 18. Filtered fuel flows into the vane pump stage and is pressurized for delivery to the engine during the cranking operation. At low speeds, the vane pump provides a pressure rise typically up to 300 psi above its inlet pressure as regulated by the relief valve 26. During cranking, the centrifugal stage acts only as a boost pump to overcome losses in the heater, filter and in the passages in providing flow to the vane stage inlet 22. The discharge valve 20 remains closed to flow during this low speed cranking period because of the higher pressure in the discharge port 21.

The relief valve 26 limits the pressure rise across the vane stage and has its pressure set point reduced as pressure from the centrifugal stage increases. By means of the valve 26, the vane stage is unloaded as the speed increases and the centrifugal stage pressure approaches 300 psi at about 13,500 rpm. At speeds above 13,500 rpm, the centrifugal stage pressure will exceed the engine pressure requirements of 300 psi in the discharge port 21 and the valve 19 opens, allowing flow to the engine to take place.

After reaching 13,500 rpm and a pressure of 300 psi across the centrifugal stage, the clutch actuation valve 30 opens and allows flow to be delivered to the pressure actuated clutch 25. The clutch 25 operates to disengage the vane stage pump. The vane stage rotor and associated clutch members come to a stop and operation is sustained by the centrifugal stage alone. Filter flow under these conditions is reduced to that required to maintain the pressure operated clutch 25 deactuated, and to satisfy bleed flow requirements through the resistance valve 33 which is closed because the spring 34 provides a pressure which is slightly higher than the pressure of the biasing spring 20 acting on the check valve member 19. The vent hole 35 in the resistance valve allows air to be pumped by the vane stage during dry lift cranking. This vent hole is small enough to limit fuel flow to approximately 1 gallon per minute after the vane stage stops.

The body valve member 36 offers a resistance to return flow as required to eliminate air recirculation during the priming operation and to provide an effective interstage pressure above the pump inlet pressure for the fuel control.

Under no circumstances does the vane stage pressure exceed the 300 psi relief valve setting for the valve element 26. It should also be noted that the vane pump pressure rise diminishes to nearly zero as the pump speed approaches the 13,500 rpm transition speed. In this way, the vane pump loads are minimized and the cutout transition is made with the blade loading removed. In addition, the vane stage relief valve 26 and the clutch actuation valve 30 and the clutch 25 itself are afforded protection against fuel contaminants at all times by the filter 18.

Operation of the vane pump is reestablished when the speed is reduced and the centrifugal stage pressure drops below 300 psi. The reaction of the vane stage occurs with essentially no pressure load since the relief valve 26 is biased to the fully open position at the time the clutch 25 engages. The operation of this relief valve thereby assures a smooth transition in pump operation with no pressure transients being introduced into the fuel control.

Figure 4:
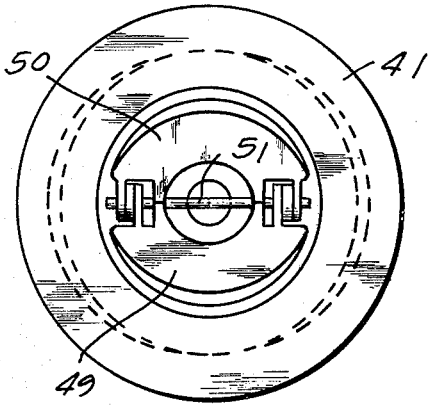
FIG. 4 is a front elevational view of the assembly shown in FIGS. 2 and 3.

The embodiment of the invention shown in FIGS. 2 through 4 illustrates a centrifugally activated vane latching mechanism for deactuating the vane pump when the centrifugal pump reaches a predetermined speed. The vane pump there illustrated includes a stator housing 41 including inlet ports 42 and 43 as well as outlet ports 44 and 45 (FIG. 3). The pump includes four symmetrical vane blades 46 which ride in a circular rotor 47 positioned in the ellipsoidal or similarly shaped stator housing 41. Each of the blades 46 has a ramped tang 48 which extends radially inwardly toward the center of the rotor 47. At low speeds, the rotor blades 46 slide in and out of their rotor slots to maintain a seal between the rotor 47 and the stator housing 41. A pair of centrifugal governor weights 49 and 50 are hinged to the rotor by means of a shaft 51. The weights 49 and 50 swing radially outwardly at high speeds and move a sliding retainer 52 axially against the action of a spring 53 until the sliding retainer 52 engages with the tangs 48. After engagement, the blades 46 are retracted into their inward radial position, and the pump no longer displaces fluid. The rotor 47 continues to rotate at high speeds, but no sliding or wearing of the blades 46 takes place. When the speed is sufficiently reduced, the spring 53 overcomes the centrifugally induced forces of the weights 49 and 50, causing the blades 46 to be moved outwardly into their pumping position, and pumping resumes. The symmetrical arrangement of the system shown in these figures eliminates any unbalance forces which might otherwise result at high rotational speeds.

Figure 5:
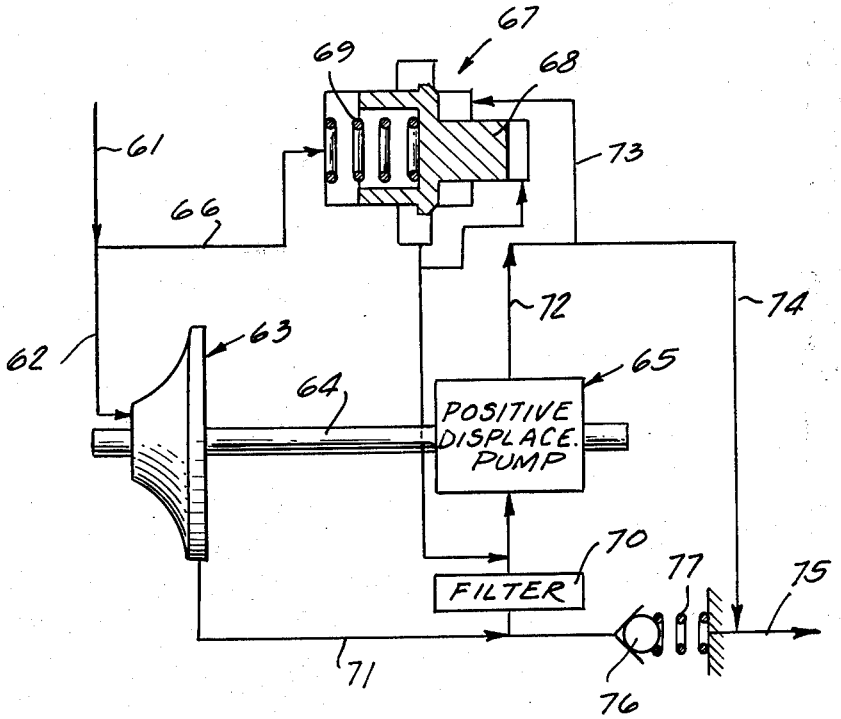
FIG. 5 is a schematic representation of another pump assembly in accordance with the present invention which relies upon a throttling type fuel control for unloading the positive displacement pump after the engine is started.

The embodiment illustrated in FIG. 5 of the drawings makes use of a throttling type fuel control at the pump discharge to provide for high efficiency and low temperature rise and to build cranking pump pressure. A fluid flow inlet line 61 delivers fuel by means of a line 62 to a centrifugal pump generally indicated at reference numeral 63. The centrifugal pump 63 includes a shaft 64 which drives a positive displacement pump indicated at reference numeral 65 in the drawings. Fluid flow in the line 61 is partially diverted by means of a line 66 to a biased relief valve generally indicated at reference numeral 67 including a valve element 68 biased by means of a spring 69. A filter 70 receives fuel from the discharge of the centrifugal pump 63 through a line 71. The discharge of the positive displacement pump 65 is taken through a line 72, a portion of which goes to the biased relief valve 67 by means of a line 73 and another portion by means of a line 74 is directed to a discharge outlet 75. A check valve consisting of a ball element 76 biased by a spring 77 is provided between the discharge line 71 of the centrifugal pump and the outlet line 75.

At low cranking speeds, the centrifugal stage pressure rise is very low and the discharge pressure in the discharge line 75 is supplied by the positive displacement pump 65 through the line 72. When the centrifugal stage pressure rises to the pressure in the line 61, the discharge pressure in the line 75 is controlled by the setting of the spring 69 in the relief valve. As the pump speed increases, the centrifugal stage pressure will rise above the input pressure in the line 61 and a net force which opposes the spring force provided by spring 69 is developed across the relief valve element 68. The pressure rise across the positive displacement pump 65 will therefore be held to a lower value. When the speed further increases, the centrifugal stage pressure will reach the value of the discharge pressure in the line 75 and the spring forces provided in the relief valve spring 69 will be completely overcome, and all of the positive displacement pump flow from pump 65 is bypassed with no pressure rise. At this point, the positive displacement pump 65 is unloaded and only the centrifugal pump 63 supplies engine demands.

The check valve element 76 remains closed in the system when the pressure in the discharge line 75 is greater than the centrifugal stage pressure and the centrifugal pump 63 feeds the positive displacement pump 65. When the positive displacement pump 65 is unloaded, the centrifugal stage pressure will equal or exceed the discharge pressure, and flow will pass through the check valve 76 from the centrifugal pump 63 into the discharge line 75.

From the foregoing, it will be evident that the improved fuel pump assembly of the present invention provides the combination of a centrifugal main stage operating at high speed and a positive displacement pump which satisfies dry lift and cranking flow requirements. The positive displacement type pump is self-sealing and is capable of displacing air in the lines and the pump to develop a suction head which draws fuel from the tank. Once fuel has entered the pump and the engine is started, however, the positive displacement type pump is disengaged at high operating speeds. The fuel requirements are then supplied by the centrifugal pump which is virtually insensitive to contaminants. The bypass valve arrangement allows the positive displacement pump to be disengaged and re-engaged with essentially no pressure rise or load on the pump or clutch at the time the transition takes place. Since the positive displacement stage operates only for short intervals, only minimal filter capacity is required to insure clean fuel to this stage.

It should be evident that various modifications can be made to the described embodiments without departing from the scope of the present invention.

We claim as our invention:

1. A fuel pumping system comprising a main stage including a centrifugal pump, a secondary stage including a positive displacement pump, a common drive means for said main stage and said secondary stage, speed responsive means associated with said positive displacement pump and responsive to the speed of said centrifugal pump to terminate pumping action by said positive displacement pump upon said centrifugal pump reaching a predetermined speed, and a valve means to remove load from the positive displacement pump prior to terminating operation.

2. The pumping system of claim 1 in which said positive displacement pump is a vane or gear pump.

3. The pumping system of claim 1 in which said speed responsive means includes a hydraulically actuated clutch.

4. The pumping system of claim 2 in which said speed responsive means includes a centrifugally actuated vane latch mechanism for disabling said vane pump.

5. A fuel pumping system comprising a centrifugal pump, a vane pump, a common drive shaft for said centrifugal and said vane pumps, pressure relief means across said vane pump responsive to the output pressure from said centrifugal pump, and a hydraulically actuated clutch actuated by a buildup of pressure in said pressure relief means to disengage the vane pump into a non-rotating condition at a predetermined output pressure of said centrifugal pump, said pressure relief means functioning to maintain the vane pump in unloaded condition at the time of engagement and disengagement of said clutch.

6. A fuel pumping assembly comprising a centrifugal pump, a vane pump, a common drive means for said centrifugal pump and said vane pump, a filter in the inlet of said vane pump, a relief valve disposed across said vane pump and responsive to the pressure differential between the inlet and the output of said vane pump, a pressure actuated clutch arranged to engage and disengage said vane pump, a discharge port for discharging pressurized fluid from said pumping assembly, a resistance valve responsive to the pressure differential between said discharge port and the output of said vane pump, a clutch actuation valve connected between said relief valve and said pressure actuated clutch to actuate the same upon establishment of a predetermined pressure in said relief valve, and a check valve between said filter and said discharge port.

7. The method of supplying fuel to an engine which comprises directing fuel during engine startup to a centrifugal pump, filtering the discharge of the centrifugal pump, directing the filtered discharge into a positive displacement pump, pressurizing fuel in said positive displacement pump and deactivating said positive displacement pump to a stop when the speed of the centrifugal pump increases sufficiently to provide a sufficient pressure on the pumped fuel to meet engine requirements, said displacement pump being activated and deactivated while in an unloaded condition.

8. The method of claim 7 in which said positive displacement pump is a vane pump.

9. The method of claim 7 in which said positive displacement pump is deactivated hydraulically.

10. The method of supplying fuel to an engine which comprises directing fuel during engine startup to a centrifugal pump, filtering the discharge of the centrifugal pump, directing the filtered discharge into a positive displacement pump, pressurizing fuel in said positive displacement pump and centrifugally deactivating said positive displacement pump when the speed of the centrifugal pump increases sufficiently to provide a sufficient pressure on the pumped fuel to meet engine requirements.

11. The method of claim 7 wherein the step of deactivating occurs when speed is sufficient to activate a mechanical clutch or detent means.

* * * * *